US011495125B2

(12) United States Patent
Zhang et al.

(10) Patent No.: US 11,495,125 B2
(45) Date of Patent: Nov. 8, 2022

(54) DETECTING CHANGED DRIVING CONDITIONS

(71) Applicant: Ford Global Technologies, LLC, Dearborn, MI (US)

(72) Inventors: Linjun Zhang, Canton, MI (US); Juan Enrique Castorena Martinez, Southfield, MI (US); Codrin Cionca, Ann Arbor, MI (US); Mostafa Parchami, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 255 days.

(21) Appl. No.: 16/290,018

(22) Filed: Mar. 1, 2019

(65) Prior Publication Data

US 2020/0279478 A1 Sep. 3, 2020

(51) Int. Cl.
*G08G 1/01* (2006.01)
*G07C 5/08* (2006.01)

(52) U.S. Cl.
CPC ..... *G08G 1/0125* (2013.01); *G07C 5/0841* (2013.01); *G08G 1/0112* (2013.01)

(58) Field of Classification Search
CPC ..... G07C 5/0841; G08G 1/0125
See application file for complete search history.

(56) References Cited

U.S. PATENT DOCUMENTS 9,047,773 B2 6/2015 Chen et al.
9,560,490 B2 1/2017 Velusamy
2011/0044543 A1* 2/2011 Nakamura ..... G06V 20/588 382/190
2014/0122014 A1 5/2014 Flik et al.
2015/0142808 A1* 5/2015 Ren ..... G06K 9/6223 707/737
2016/0035150 A1* 2/2016 Barfield, Jr. ..... G05B 23/0254 701/29.3
2017/0050599 A1* 2/2017 Gilbert ..... G01H 17/00
2017/0229012 A1* 8/2017 Bills ..... G08G 1/0141
2018/0053405 A1* 2/2018 de Azevedo ..... G08G 1/123
2018/0068495 A1* 3/2018 Chainer ..... G07C 5/008
2019/0378406 A1* 12/2019 Aguirrebeitia ..... G08G 1/0133
2020/0257301 A1* 8/2020 Weiser ..... G06N 3/02
2021/0090359 A1* 3/2021 Griffiths ..... B60W 50/0225

FOREIGN PATENT DOCUMENTS

CN 106530828 A 3/2017
CN 107567005 A 1/2018
WO 2018020471 A1 2/2018

* cited by examiner

*Primary Examiner* — Jess Whittington
(74) *Attorney, Agent, or Firm* — Frank A. MacKenzie; Bejin Bieneman PLC

(57) ABSTRACT

A system comprises a computer including a processor, and a memory. The memory stores instructions such that the processor is programmed to determine two or more clusters of vehicle operating parameter values from each of a plurality of vehicles at a location within a time. Determining the two or more clusters includes clustering data from the plurality of vehicles based on proximity to two or more respective means. The processor is further programmed to determine a reportable condition when a mean for a cluster representing a greatest number of vehicles varies from a baseline by more than a threshold.

18 Claims, 7 Drawing Sheets

DETECTING CHANGED DRIVING CONDITIONS

BACKGROUND

Road conditions and weather may change or degrade quickly. Rain may lead to ponding in the middle of a road. Ice may form on the roads during cold weather. Potholes may quickly form. Hazards such as dead animals, tree branches, tire debris, etc., may form on a road. Additionally, weather conditions such as rain, snow and fog may be localized to certain segments of a road. Conventional methods of detecting and reporting these changed conditions can be slow. Further, sensors that detect changed conditions may be ineffective in adverse weather conditions.

DETAILED DESCRIPTION

Introduction

Figure 1:
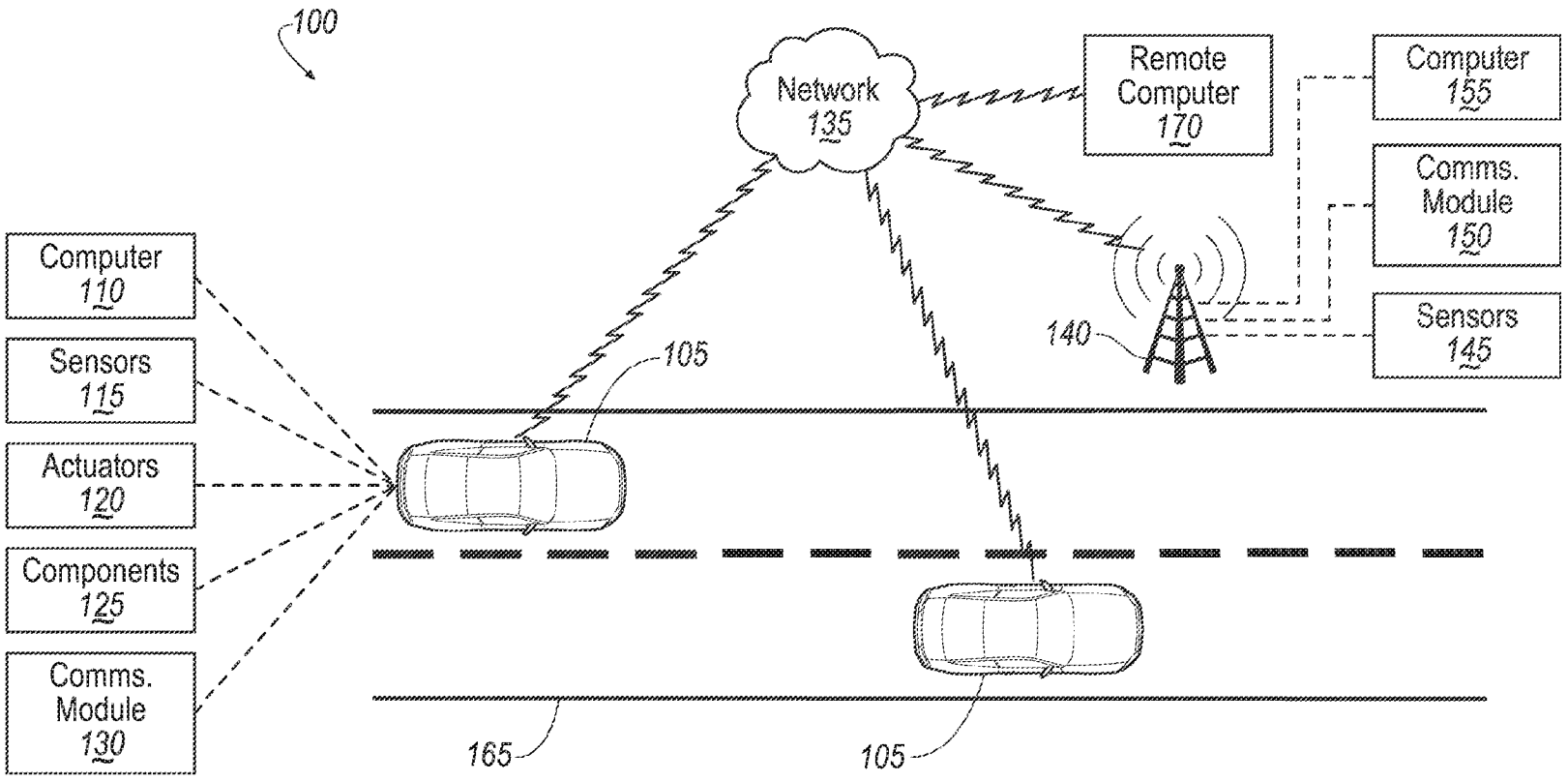
FIG. 1 is a diagram illustrating an example system for detecting a changed driving condition.

Disclosed is a system comprising a computer including a processor, and a memory. The memory storing instructions such that the processor is programmed to: determine two or more clusters of vehicle operating parameter values from each of a plurality of vehicles at a location within a time. Determining the two or more clusters includes clustering data from the plurality of vehicles based on proximity to two or more respective means. The processor is further programmed to determine a reportable condition when a mean for a cluster representing a greatest number of vehicles varies from a baseline by more than a threshold.

A number of the two or more clusters can be specified prior to determining the two or more clusters.

The baseline can be an expected value of the vehicle operating parameter values.

The baseline can be determined based on historical data gathered at the location from at least a minimum number of vehicles.

The baseline can be determined based on one or more traffic regulations.

The baseline can be determined based on weather data.

The vehicle operating parameter values from each of the plurality of vehicles can be a respective value of a same vehicle operating parameter. The same vehicle operating parameter can be selected from a set of: a vehicle speed, a vehicle position relative to a lane, a vehicle acceleration, a vehicle trajectory, a vehicle wiper speed, an actuation of fog lights, an operating parameter specifying operation of a vehicle suspension and an actuation of electronic stability control.

The vehicle operating parameter values for each of the plurality of vehicles can include a value of a same first vehicle operating parameter from each vehicle and a value of a same second vehicle operating parameter from each vehicle.

The processor can be further programmed to determine the mean for the vehicle operating parameter values respectively for each of the two or more clusters based on a k-means algorithm.

The processor can be further programmed to report the location to at least one from a set of a server, a vehicle included in the plurality of vehicles, and a vehicle not included in the plurality of vehicles.

The computer can be included in a traffic infrastructure.

The processor can be further programmed to apply a filter to at least some of the data prior determining the two or more clusters of vehicle operating parameter values from each of the plurality of vehicles at the location within the time.

The filter can be one selected from a set of a low-pass filter and a Kalman filter.

Further disclosed is A method comprising: determining two or more clusters of vehicle operating parameter values from each of a plurality of vehicles at a location within a time. Determining the two or more clusters includes clustering data from the plurality of vehicles based on proximity to two or more respective means. The method further comprises determining a reportable condition when a mean for a cluster representing a greatest number of vehicles varies from a baseline by more than a threshold.

A number of the two or more clusters can be specified prior to determining the two or more clusters.

The baseline can be determined based on historical data gathered at the location from at least a minimum number of vehicles.

The vehicle operating parameters from each of the plurality of vehicles can be a same operating parameter.

The method can further comprise determining the mean for the vehicle operating parameter values respectively for each of the two or more clusters based on a k-means algorithm.

The method can further comprise applying a filter to at least some of the data prior determining the two or clusters of vehicle operating parameter values from each of the plurality of vehicles at the location within the time.

Further disclosed herein is a computing device programmed to execute any of the above method steps.

Yet further disclosed herein is a computer program product, including a computer readable medium storing instructions executable by a computer processor, to execute an of the above method steps.

Exemplary System Elements

A stationary support structure can support various components, such as sensors and a computer mounted thereto (e.g., with various mounting mechanisms, housings, etc.). The computer can be programmed to receive vehicle data from one or more vehicles proximate to the support structure during a data collection period, the data specifying values of operating parameters of the vehicle. The computer can be programmed to identify data clusters of vehicle operating parameter values at locations proximate to the support structure. The clusters can identify operating parameters with like or similar values for multiple vehicles at a location. By clustering like operating parameters from one or more vehicles at locations during the data collection period, the computer can identify locations where the values of same or like operating parameters for the plurality of vehicles vary from a baseline value. In an example, the computer determines locations where a cluster of values of the operating parameter for a majority of vehicles has a centroid (i.e., geometric center) that is different from a baseline value by more than a threshold. Such a condition may indicate a changed driving condition at or near the locations. A location, as used herein, is a specified point on the surface of the earth, typically specified according to a conventional longitude-latitude pair of geo-coordinates.

FIG. 1 is a block diagram of an example infrastructure communications and control system (or infrastructure system) 100. The system 100 includes one or more vehicles 105, each of which is a land vehicle such as a car, truck, motorcycle, etc. Each vehicle 105 can include a vehicle computer 110, sensors 115, actuators 120 to actuate various vehicle components 125, and a vehicle communications module 130. Via a network 135, the vehicle communications module 130 may allow the vehicle computer 110 to communicate with one or more data collection or infrastructure nodes 140 and a remote computer 170. The infrastructure nodes 140 may also be referred to herein as a traffic infrastructure 140. The vehicles 105 are illustrated operating on a road 165. Two vehicles 105 are shown in FIG. 1 for ease of illustration, but the system 100 can include one or more vehicles 105.

The vehicle computer 110 includes a processor and a memory such as are known. The memory includes one or more forms of computer-readable media, and stores instructions executable by the vehicle computer 110 for performing various operations, including as disclosed herein.

The vehicle computer 110 may operate a vehicle 105 in an autonomous, a semi-autonomous mode, or a non-autonomous (or manual) mode. For purposes of this disclosure, an autonomous mode is defined as one in which each of vehicle 105 propulsion, braking, and steering are controlled by the vehicle computer 110; in a semi-autonomous mode the vehicle computer 110 controls one or two of vehicles 105 propulsion, braking, and steering; in a non-autonomous mode a human operator controls each of vehicle 105 propulsion, braking, and steering.

The vehicle computer 110 may include programming to operate one or more of vehicle 105 brakes, propulsion (e.g., control of acceleration in the vehicle by controlling one or more of an internal combustion engine, electric motor, hybrid engine, etc.), steering, climate control, interior and/or exterior lights, etc., as well as to determine whether and when the vehicle computer 110, as opposed to a human operator, is to control such operations. Additionally, the vehicle computer 110 may be programmed to determine whether and when a human operator is to control such operations.

The vehicle computer 110 may include or be communicatively coupled to, e.g., via a vehicle 105 communications bus as described further below, more than one processor, e.g., included in electronic control units (ECUs) or the like included in a vehicle 105 for monitoring and/or controlling various vehicle components 125, e.g., a powertrain controller, a brake controller, a steering controller, etc. The vehicle computer 110 is generally arranged for communications on a vehicle communication network that can include a bus in the vehicle such as a controller area network (CAN) or the like, and/or other wired and/or wireless mechanisms.

Via the vehicle 105 network, the vehicle computer 110 may transmit messages to various devices in the vehicle 105 and/or receive messages from the various devices, e.g., sensors 115, an actuator 120, vehicle components 125, a human machine interface (HMI), etc. Alternatively or additionally, in cases where the vehicle computer 110 actually comprises a plurality of devices, the vehicle 105 communications network may be used for communications between devices represented as the vehicle computer 110 in this disclosure. Further, as mentioned below, various controllers and/or sensors 115 may provide data to the vehicle computer 110 via the vehicle communication network.

Vehicle 105 sensors 115 may include a variety of devices such as are known to provide data to the vehicle computer 110. For example, the sensors 115 may include Light Detection And Ranging (LIDAR) sensor(s) 115, etc., disposed on a top of the vehicle 105, behind a vehicle 105 front windshield, around the vehicle 105, etc., that provide relative locations, sizes, and shapes of objects surrounding the vehicle 105. As another example, one or more radar sensors 115 fixed to vehicle 105 bumpers may provide data to provide locations of the objects, second vehicles 105, etc., relative to the location of the vehicle 105. The sensors 115 may further alternatively or additionally, for example, include camera sensor(s) 115, e.g. front view, side view, etc., providing images from an area surrounding the vehicle 105.

The vehicle 105 actuators 120 are implemented via circuits, chips, or other electronic and or mechanical components that can actuate various vehicle subsystems in accordance with appropriate control signals as is known. The actuators 120 may be used to control vehicle components 125, including braking, acceleration, and steering of a vehicle 105.

In the context of the present disclosure, a vehicle component 125 is one or more hardware components adapted to perform a mechanical or electro-mechanical function or operation—such as moving the vehicle 105, slowing or stopping the vehicle 105, steering the vehicle 105, etc. Non-limiting examples of vehicle components 125 include a propulsion component (that includes, e.g., an internal combustion engine and/or an electric motor, etc.), a transmission component, a steering component (e.g., that may include one or more of a steering wheel, a steering rack, etc.), a brake component (as described below), a park assist component, an adaptive cruise control component, an adaptive steering component, a movable seat, a suspension, an electronic stability control (ESC) module, a wiper control module, fog lights, etc.

In addition, the vehicle computer 110 may be configured for communicating via a vehicle communications module 130 with devices outside of the vehicle 105, e.g., through a vehicle-to-vehicle (V2V) or vehicle-to-infrastructure (V2X) wireless communications to another vehicle, to an infrastructure node 140 (typically via direct radio frequency communications) and/or (typically via the network 135) a remote computer 170. The vehicle communications module 130 can include one or more mechanisms by which the computers 110 of vehicles 105 may communicate, including any desired combination of wireless (e.g., cellular, wireless, satellite, microwave and radio frequency) communication mechanisms and any desired network topology (or topologies when a plurality of communication mechanisms are utilized). Exemplary communications provided via the vehicle communications module 130 include cellular, Bluetooth, IEEE 802.11, dedicated short-range communications (DSRC), cellular V2V, 5G/LET and/or wide area networks (WAN), including the Internet, providing data communication services.

The network 135 represents one or more mechanisms by which a vehicle computer 110 may communicate with an infrastructure node 140 and/or remote computer 170. Accordingly, the network 135 can be one or more of various wired or wireless communication mechanisms, including any desired combination of wired (e.g., cable and fiber) and/or wireless (e.g., cellular, wireless, satellite, microwave, and radio frequency) communication mechanisms and any desired network topology (or topologies when multiple communication mechanisms are utilized). Exemplary communication networks include wireless communication networks (e.g., using Bluetooth®, Bluetooth® Low Energy (BLE), IEEE 802.11, vehicle-to-vehicle (V2V) such as Dedicated Short-Range Communications (DSRC), 5G/LET, etc.), local area networks (LAN) and/or wide area networks (WAN), including the Internet, providing data communication services.

An infrastructure node 140 includes a physical structure such as a tower or other support structure (e.g., a pole, a box mountable to a bridge support, cell phone tower, road sign support, etc.) on which infrastructure sensors 145, as well as an infrastructure communications module 150 and infrastructure computer 155 can be mounted, stored, and/or contained, and powered, etc. One infrastructure node 140 is shown in FIG. 1 for ease of illustration, but the system 100 could include one or more infrastructure nodes 140. In a case of the system 100 having multiple infrastructure nodes 140, one of the infrastructure nodes 140 may assume responsibility for communicating with vehicles 105 proximate to the infrastructure node 140. "Proximate" to the infrastructure node is defined herein as within a detection range of the infrastructure sensors 145 and/or within a reception range of vehicle-to-infrastructure (V2X) communications, for example V2X communications based on Dedicated Short-Range Communications (DSRC) or 5G/LET.

The infrastructure node 140 is typically stationary, i.e., fixed to and not able to move from a specific geographic location, and may be referred to herein as a stationary support structure. The infrastructure sensors 145 may include one or more sensors such as described above for the vehicle 105 sensors 115, e.g., LIDAR, radar, cameras, ultrasonic sensors, etc. The infrastructure sensors 145 are fixed or stationary. That is, each infrastructure sensor 145 is mounted to the infrastructure node 140 so as to have a substantially unmoving and unchanging field of view. Alternatively or additionally, an infrastructure sensor 145 could be mounted to rotate or otherwise move a field of view, e.g., on a movable arm, rotatable platform, or the like.

The infrastructure communications module 150 and infrastructure computer 155 typically have features in common with the vehicle computer 110 and vehicle communications module 130, and therefore will not be described further to avoid redundancy. Although not shown for ease of illustration, the infrastructure node 140 also includes a power source such as a battery, solar power cells, and/or a connection to a power grid.

The infrastructure computer 155 can be programmed to receive data from one or more vehicles 105 proximate to the infrastructure node 140. For each vehicle 105, the data can indicate values for different operating parameters of the vehicle 105. An operating parameter is a datum or data that specifies a physical condition or measurement of vehicle operation, of the vehicle 105 or a vehicle component 125 of the vehicle 105 operation at a time. Non-limiting examples of operating parameters include activation state (actuated, on, off, idled), vehicle location, vehicle speed, vehicle heading, vehicle acceleration, vehicle position relative to a lane, a temperature, a pressure, an angle of one component relative to reference point (e.g., an angle of wheels relative to straight ahead), a wiper speed, a rotational velocity (e.g., engine speed in revolutions per minute), an amplitude (e.g., of an oscillation of a suspension), a frequency (e.g., a frequency of oscillation of a suspension), etc.

In some cases, the infrastructure computer 155 can further be programmed to collect traffic signal data. For example, the infrastructure computer can be programmed to collect a state (red, yellow, green) of a traffic signal that affects or may affect a vehicle operating parameter at a time. A vehicle operating parameter such as velocity or acceleration, for example, may be affected by a state of a traffic signal which the vehicle 105 is approaching.

The infrastructure node 140 collects and processes vehicle data from a region of interest. A region of interest is defined herein as an area of vehicle traffic for which it is desired to identify changed driving conditions based on vehicle data. A region of interest may be defined relative to a road 165 or include a road 165. A road 165 herein can be any surface designated for travel by vehicles. Non-limiting examples of roads 165 include conventional roads, highways, streets with one or two-direction traffic and one or more lanes in each direction, intersections, parking lots, etc. The region of interest for the infrastructure node 140 may be defined, for example, as a portion of a road 165 plus an area extending from each side of the road 165 for a fixed distance such as 20 meters.

The remote computer 170 can be a conventional computing device, i.e., including one or more processors and one or more memories, programmed to provide operations such as disclosed herein. Further, the remote computer 170 can be accessed via the network 135, e.g., the Internet or some other wide area network. The remote computer 170 can provide data, such as map data to the infrastructure computer 155 or the vehicle computer 110.

The infrastructure computer 155 can be programmed to perform data clustering on vehicle data received from the vehicles 105, i.e., from vehicle computers 110. Data clustering means assigning n datum to k clusters such that each datum is assigned to a cluster based on proximity to a mean. That is, the datum are assigned to the cluster with the nearest mean. The clustering process is described herein with respect to a datum from each vehicle 105 included in the clustering process. The described cluster process can also apply to sets of datum specifying values for two or more operating parameters respectively for each vehicle 105. For example, clustering can be performed based on a set of data respectively from each vehicle specifying a position and a heading. One example of a clustering method is k-means.

In an example, a set of n datum includes $(x_1, x_2, \ldots, x_n)$ where each datum is a d-dimensional real vector. The k-means method seeks to cluster the n datum into k ($k \leq n$) sets $S=\{s_1, s_2, \ldots, s_k\}$ to minimize the variance within each cluster, where the variance is the within-cluster sum of squares. This is expressed in equation 1:

$$\underset{S}{\operatorname{argmin}} \sum_{i=1}^{k} \sum_{x \in S_i} \|x - u_i\|^2 = \underset{S}{\operatorname{argmin}} \sum_{i=1}^{k} |S_i| \operatorname{Var} S_i \qquad \text{Eq. 1}$$

where $u_1$ is the mean of the datum in $S_i$. This is equivalent to minimizing the pairwise squared deviations of points in the same cluster and can be expressed as:

$$\underset{s}{\operatorname{argmin}} \sum_{i=1}^{k} \frac{1}{2|S_i|} \sum_{x,y \in S_i} \|x-y\|^2.$$

The equivalence can be deduced from identity:

$$\Sigma_{x \in S_i} \|x-u_i\|^2 = \Sigma_{x,y \in S_i} (x-u_i)(u_i-y).$$

An example algorithm for implementing k-means clustering uses a two-step iterative process. In a first step, which can be referred to as the assignment step, each datum is assigned to the cluster that has the least squared distance. This can be expressed according to equation 2, below:

$$S_i^{(t)} = \{x_p : \|x_p - m_i^{(t)}\|^2 \leq \|x_p - m_j^{(t)}\|^2 \forall_j, 1 \leq j \leq k\}, \quad \text{Eq. 2}$$

where each $x_p$ is assigned to exactly one $S^{(t)}$, even if $x_p$ could be assigned to two or more $S^{(t)}$.

The second step is an update step, wherein each of the means $m_i^{(t)}$ is recalculated to be the centroids of the clusters k identified according to equation 3, shown below:

$$m_i^{(t+1)} = \frac{1}{|S_i^{(t)}|} \cdot \sum_{x_j \in S_i^{(t)}} x_j \quad \text{Eq. 3}$$

After updating the values to each of the means, the process repeats the assignment step according to equation 2, above. The process continues to iterate between the assignment step and the update step until none of the datum $x_p$ are reassigned during the assignment step.

To apply k means clustering, initial values of the k means need to be selected. One possibility for selecting initial values for the k means is to select k datum from the initial data independent of the values of the datum. For example, in the case that k=2, the first and last datum, the second and fourth datum, or any other two datum within the collected data could be selected as the initial k means. In other examples, initial values for the k means may be made based on expected values for each mean. For example, at a given point in a right lane of a highway, there could be two expected headings; straight ahead or changing from the right to the left lane. A first mean could be selected to be parallel to (i.e., 0° angle relative to) the direction of the highway, and a second mean could be a 45° angle relative to the direction of the highway, toward the left lane.

Figure 2:
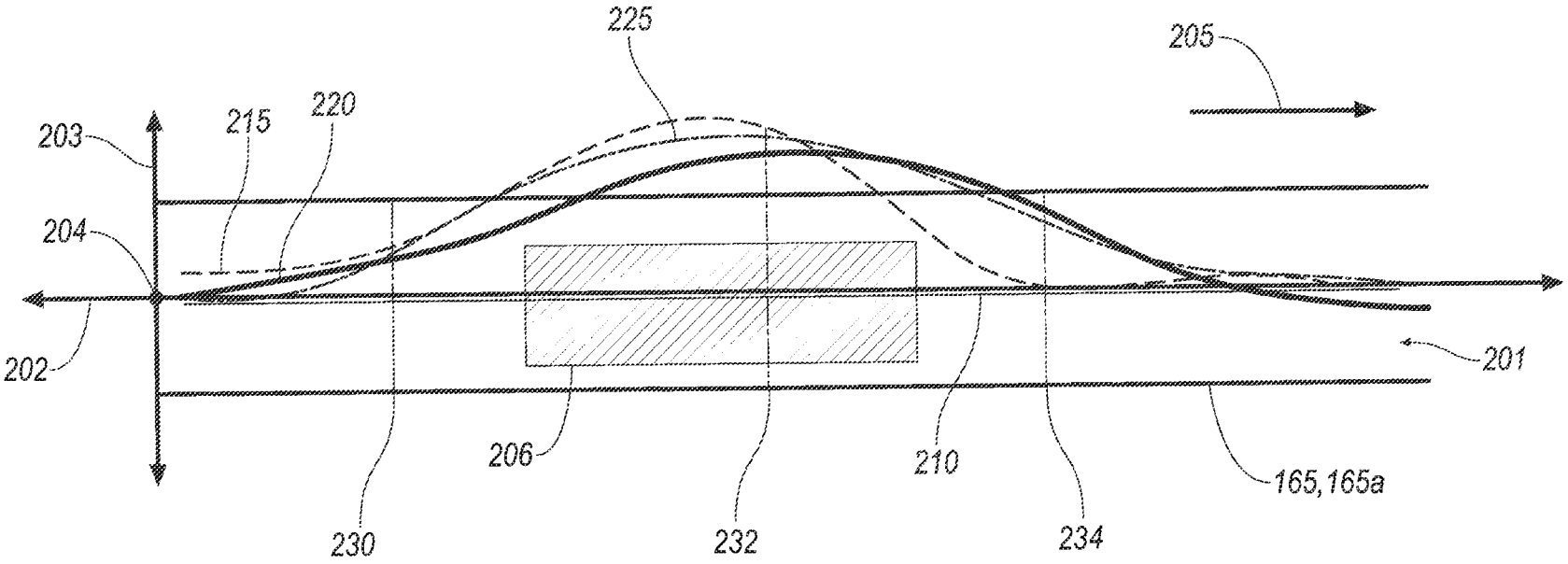
FIG. 2 is a block diagram illustrating example vehicle trajectories along a lane of a road.

FIG. 2 shows an example of data that can be collected from a lane 201 of a road 165*a*. The lane 201 has a centerline 202. A distance from the centerline 202 can be measured along an axis 203 perpendicular to the centerline 202. The distance from the centerline 202 is zero at the zero point 204 along the axis 203. The heading 205 indicates a heading along the lane 201 of the road 165*a*. Following the heading 205, positions to the right of the centerline 202 have a negative lane position. For example, a lane position one meter to the right of the centerline 202 can be assigned a lane position of minus one (−1) meters.

First, second, third and fourth vehicle trajectories 210, 215, 220 and 225 indicate routes taken by different vehicles 105 along the lane 201 at different times within a data collection period T. Along the heading 205, the first, second, third and fourth directories pass the first, second and third position markers 230, 232 and 234. Each of the first, second and third position markers 230, 232 and 234 indicate a position along the lane 201.

As the vehicles 105 travel along the first, second, third and fourth trajectories, the vehicles 105 can transmit data to the infrastructure computer 155. The data may Table 1 below shows an example of the data from the four trajectories 210, 215, 220, 225 at the position marker 230.

| Data at position marker 230 | | | |
|---|---|---|---|
| Trajectory | Speed (kilometers per hour) | Heading relative to centerline 202 (angle in degrees) | Lane position relative to centerline 202 (meters) |
| 210 | 85 | 0 | −0.1 |
| 215 | 90 | 30 | 0.8 |
| 220 | 92 | 25 | 0.7 |
| 225 | 98 | 28 | 0.6 |

As shown in FIG. 2, the second, third and fourth vehicle trajectories 215, 220, 225 curve around an area 206 on the road 165*a*, while the first vehicle trajectory passes through the area 206. As described below, the computer 155, based on clustering of the vehicle data, may detect that a mean of the trajectory of the majority of vehicles 105 during a data collection period curve around the area 206. This may be a deviation from a baseline trajectory and indicate that the region 160 includes a changed driving condition such as a pot hole, debris or water ponding.

Figure 3A:
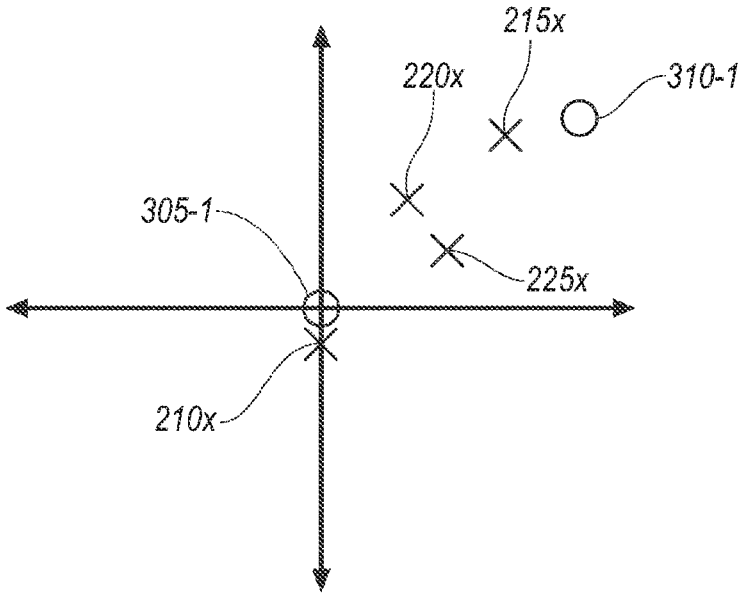
FIG. 3A illustrates example vehicle trajectory data and initial centroid locations at a beginning of an example clustering process.
Figure 3B:
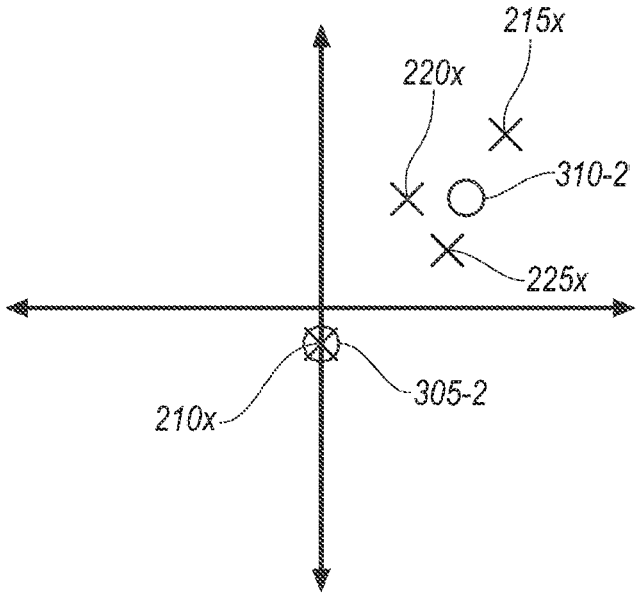
FIG. 3B illustrates the example trajectory data and final centroid locations at an end of the example clustering process of FIG. 3A.

FIGS. 3A and 3B show an example of clustering data based the first, second, third and fourth trajectories 210, 215, 220, 225 at the first position marker 230. The graph of FIG. 3A shows four datum 210*x*, 215*x*, 220*x*, 225*x* representing respectively a lane position and angle (heading relative to the centerline 202) of the first, second, third and fourth trajectories 210, 215, 220, 225. In the example, the number of clusters, k=2. That is, the datum will be clustered in two sets. The computer 155 can be programmed to select to first mean 305-1 as a trajectory following the centerline 202. That is, lane position=0 and angle=0. The computer 155 can further be programmed to select the second mean 305-2 as at a position of one meter to the left of the centerline 202 along a heading and changing lanes at an angle of 45.

In this simple example, the computer 155, in the assignment step, can calculate that datum 210*x* is closer to mean 305-1 than to mean 310-1, and further that datum 215*x*, 220*x*, 225*x* are closer to mean 310-1. In the update step, the computer 155 can calculate the mean 305-2 for the single datum 210*x* to simply be the speed and lane location of the datum 210*x*. The computer 155 can further calculate, based on equation 3 above, the mean 310-2 to be a location central to the datum 215*x*, 220*x*, 225*x* where the variance (sum of the squares of the differences of the three datum 215*x*, 220*x*, 225*x* from the mean) is minimized.

In this example, in a second iteration, none of the datum 210*x*, 215*x*, 220*x*, 225*x* will be reassigned to a different set. Accordingly, the k-means clustering process will end. In more complex situations, one or more datum may be reassigned to a different data set after the means were updated; in such examples, the process iterates until no datum are assigned to different sets in the assignment step.

Figure 4:
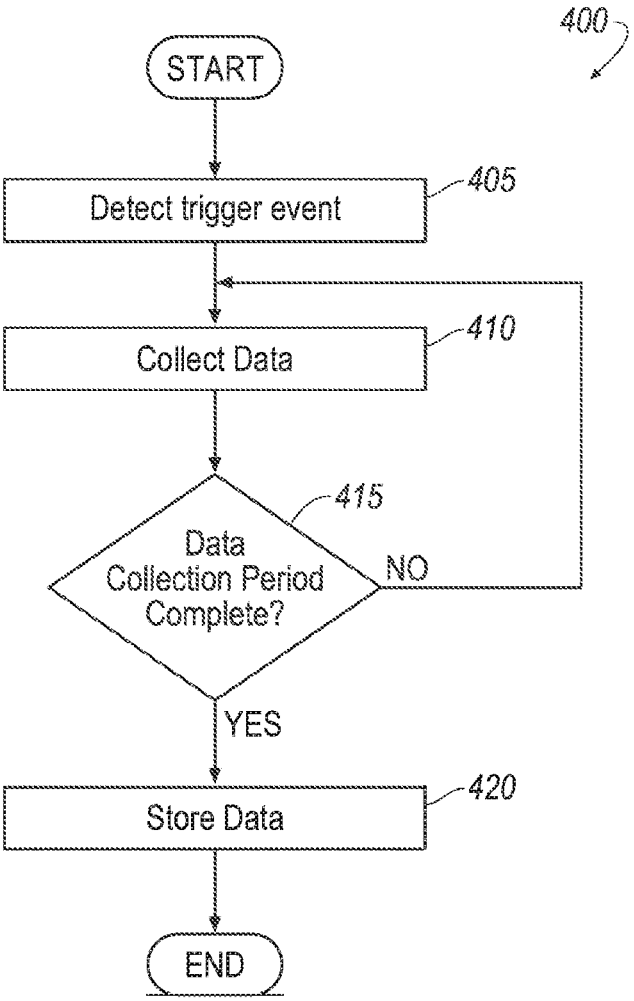
FIG. 4 is a flowchart of an exemplary process for collecting vehicle data for a region of interest.

FIG. 4 illustrates an example process 400 for collecting data from vehicles 105 travelling through a region of interest. The process 400 begins in a block 405.

In the block 405, the computer 155 is programmed to detect a trigger event to begin collecting data, i.e., the computer 155 receives a datum or data according to which the computer 155 is programmed, upon receipt of the datum or data, to initiate collecting data from vehicles 105. The trigger event may be the occurrence of a periodic signal, receipt of a message from another computer such as a vehicle computer 110, a detection of an event, etc. Non-limiting examples of events to trigger a data collection process include events deemed to mean that a vehicle is proximate to an infrastructure node 140, including receipt of a vehicle-to-infrastructure communication from a vehicle 105, detection of a vehicle 105 by infrastructure sensors 145. Alternatively or additionally, a trigger event could be receipt of a periodic signal such as a clock signal from a clock internal or external to the computer 155, such as a time-of-day signal, indicating that a time, e.g., five minutes, has passed since a previous trigger event, receiving a command from the remote computer 170 to begin the process 400, or receiving data such as weather data or traffic data indicating that driving conditions may have changed or may soon change in the region of interest, e.g., an amount of precipitation, a temperature, etc., changing by more than a threshold amount at a current or specified future time. Upon detecting the trigger event, the process continues in a block 410.

In the block 410, the computer 155 can be programmed to collect data from one or more vehicles 105 travelling proximate to the infrastructure node 140. The computer 155 may receive, for example, via the network 135 and the communications module 150 on the infrastructure node 140, messages from the one or more vehicles 105. Communications between the vehicles 105 and the infrastructure node 140 may be conducted, for example, according to a wireless protocol such as Dedicated Short-Range Communications (DSRC) or 5G/LET as described above. The messages may include vehicle data specifying vehicle operating parameters as described above. The messages may further indicate a location of each vehicle 105 and a time stamp at the time of transmitting the message. The computer 155 is programmed to store the data, for example, in temporary storage, or save the data to a database as described below. Upon receiving the messages from the one or more vehicles 105, the process 400 continues in a block 415.

In the block 415, the computer 155 is programmed to determine whether a data collection period for collecting vehicle data is complete. For example, the computer 155 may be programmed to collect vehicle data for a time period. In an example, the time period may be a fixed time period, such as 30 minutes. In another example, the computer 155 may be programmed to specify the time period based on weather conditions. For example, in a case of weather conditions that support predictable and good driving conditions, i.e., weather without precipitation, fog, and with dry roads, the computer 155 may specify the time period for data collection to be a default time period such as 30 minutes. In a case that the weather includes a likelihood of precipitation, fog, or water, snow or ice on the roads, or other conditions that may result in quickly changing driving conditions, the computer 155 may specify a shorter data collection period, such as, e.g., 5 minutes.

To determine whether the data collection period is complete or not, the computer 155 may compare a current time with a time when the trigger event was received. In the case that the time period has expired, the process 400 may continue in a block 420. Otherwise, the process 400 returns to the block 410 and continues to collect data from vehicles 105 proximate to the infrastructure node 140.

In the block 420, the computer 155 is programmed to store the vehicle data collected during the data collection period. The computer 155 may, for example, store the vehicle data in a relational database such that vehicle data indicating operating parameters of each vehicle 105 can be correlated with a location of the vehicle 105 and a time that the data was transmitted to the infrastructure node 140. The process 400 ends.

Figure 5A:
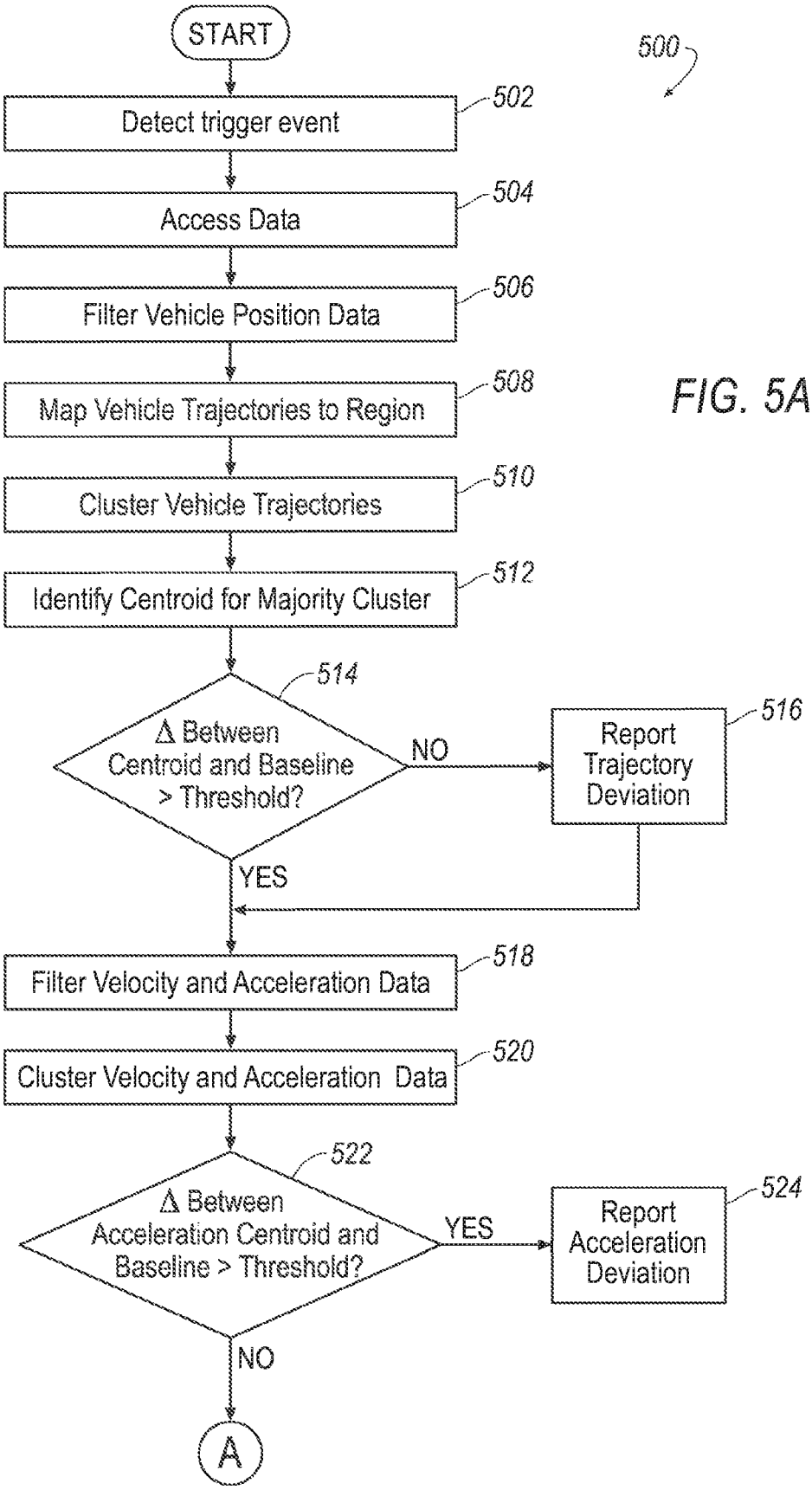
FIGS. 5A, 5B and 5C are a flowchart of an exemplary process for identifying locations of changed driving conditions based on vehicle data.
Figure 5B:
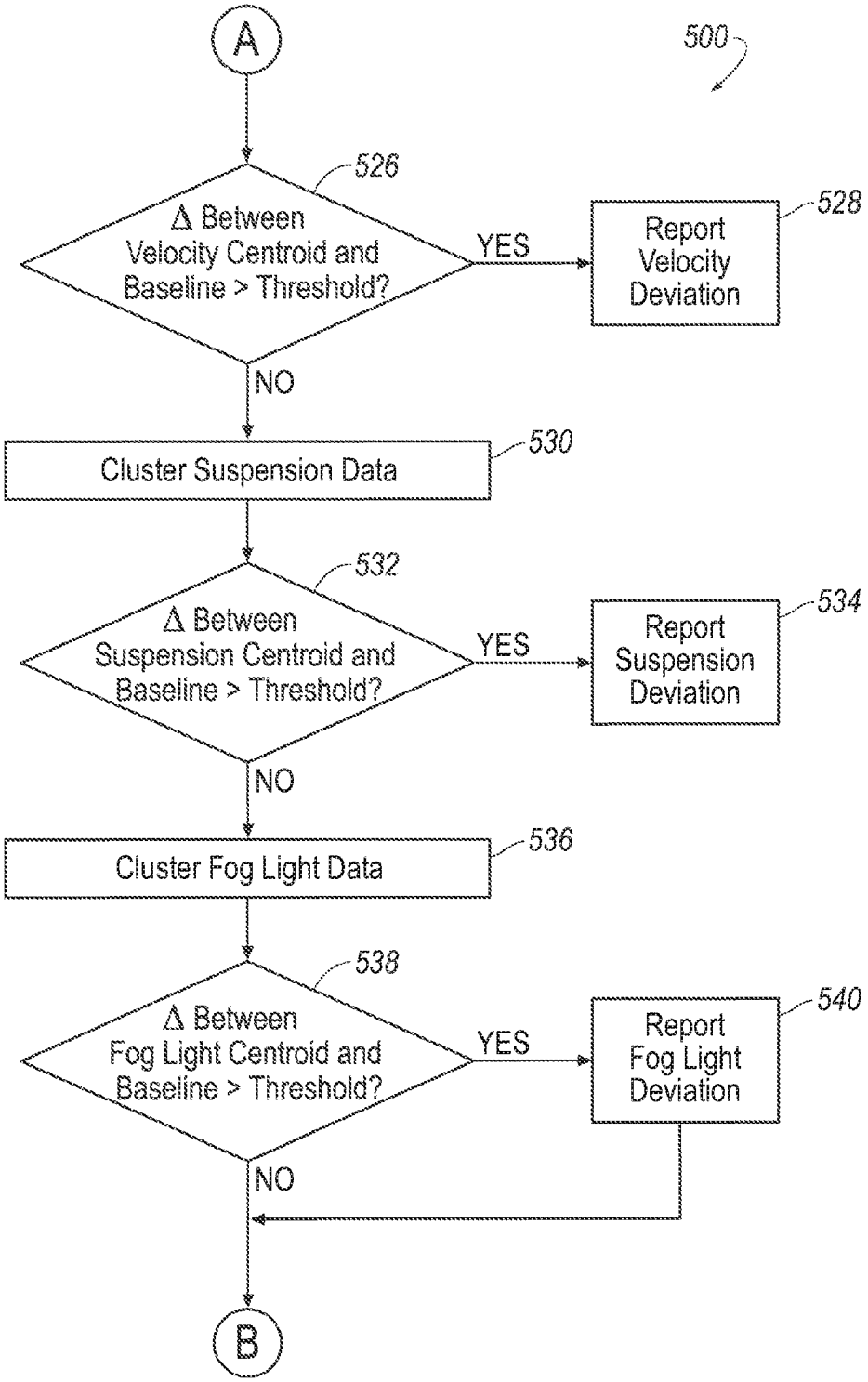
Figure 5C:
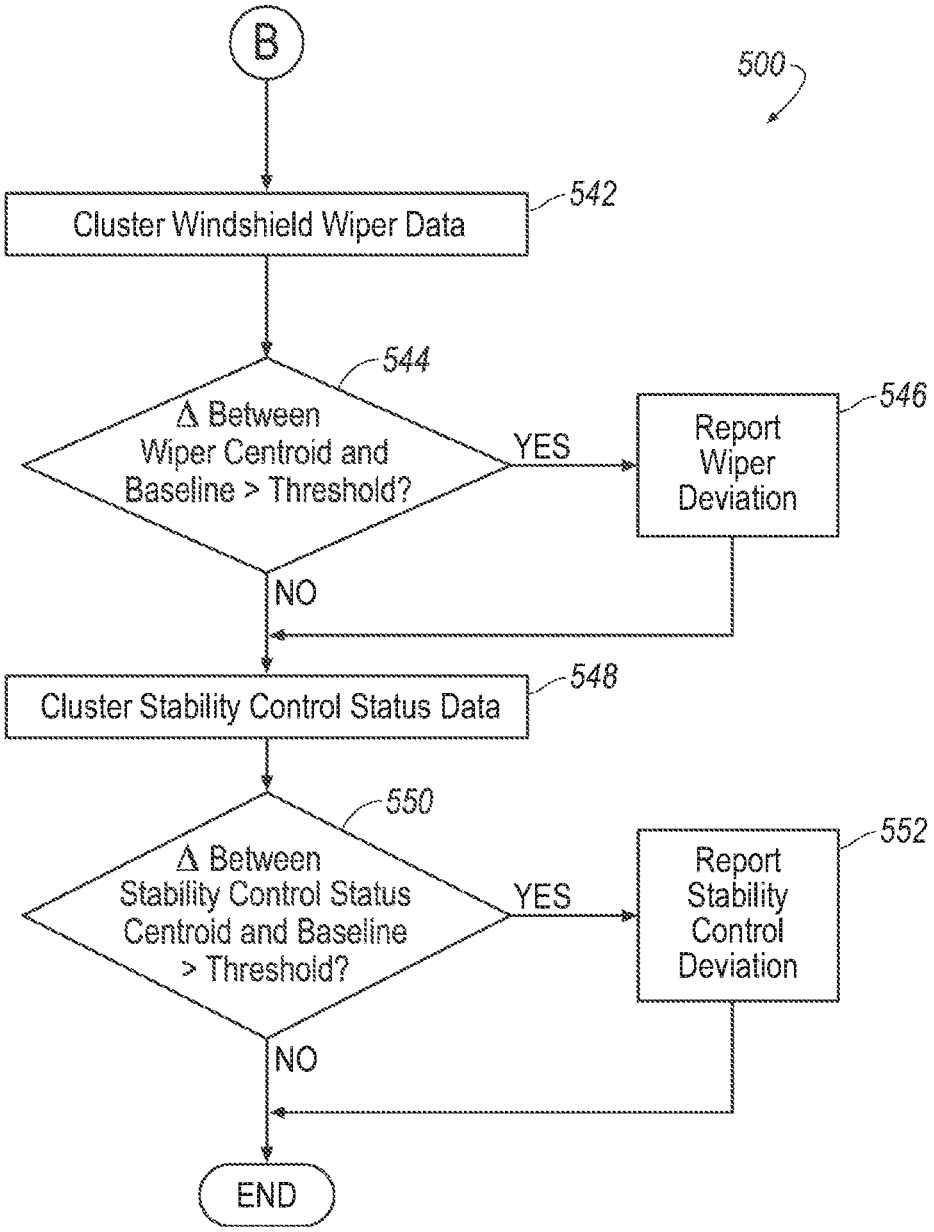

FIGS. 5A, 5B and 5C illustrate an example process 500 for identifying changed driving conditions based on vehicle data collected from one or more vehicles 105 in a region of interest. For one or more vehicle operating parameters, the computer 155 is programmed to determine two or more clusters of vehicle operating parameter values from each of a plurality of vehicles at a time. Determining the two or more clusters can include clustering data from the plurality of vehicles based on proximity to two or more respective means. The vehicle operating parameters values can be values of same operating parameters respectively for each of the vehicles. The process 500 begins in a block 502.

In the block 502, the computer 155 detects a trigger event for beginning the process 500, i.e., the computer 155 receives a datum or data according to which the computer 155 is programmed to, upon receipt of the datum or data, initiate the process 500.

The trigger event may be the occurrence of a signal or message received in the computer 155, e.g., a periodic message, message from a process being performed by the computer 155 such as the process 400, a message from another computer such as a vehicle computer 110 or the remote computer 170, a detection of an event, etc. Non-limiting examples of events to trigger a data collection process include: receipt of a message indicating that the computer 155 has completed the process 400 by collecting and storing data for a collection period, and data is available for analysis; receipt of a message from a vehicle 105 requesting updated information on driving conditions within the region of interest, detection, for example by infrastructure sensors 145 on the infrastructure node 140 of a vehicle 105 proximate to the infrastructure node 140; receipt of a periodic signal such as a clock signal from a clock internal or external to the computer 155, such as a time-of-day signal, indicating that a time, e.g., five minutes, has passed since a previous trigger event, receiving a command from the remote computer 170 to begin the process 500, and receiving data such as weather data or traffic data indicating that driving conditions may have changed in the region of interest. Upon detecting the trigger event, the process continues in a block 504.

In the block 504, the computer 155 accesses vehicle data collected from the one or more vehicles 105 by the computer 155 during a collection period. For example, the computer 155 may access vehicle data stored in the database by operation of process 400, as described above. Upon accessing the vehicle data, the process 400 continues in a block 506.

In the block 506, the computer 155 filters data related to vehicle trajectories. The data related to vehicle trajectories, for example, the vehicle trajectories 210, 215, 220, 225 of FIG. 2, may include global positioning system (GPS) data indicating a position for each vehicle 105 at specified respective times. The GPS data may, for example, specify a point on the surface of the earth according to a conventional longitude-latitude pair of geo-coordinates. Additionally, the vehicle trajectory data may include heading data of each vehicle 105 at the specified respective times. The heading data may be obtained from inertial measurement units (IMUs) on respective vehicles and specify a direction of travel relative to earth true (or magnetic) north at the vehicle position. The computer 155 can be programmed to apply a filter, such as a low-pass filter or a Kalman filter, to the GPS data and heading data to smooth trajectory curves for each of the vehicles 105.

Upon filtering the GPS data and the heading data, the process 500 continues in a block 508.

In the block 508, the computer 155 maps the trajectories for each of the vehicles 105 to the region of interest. Mapping the trajectories to the region of interest may include mapping the trajectories to position markers such as the position markers 230, 232, 234 shown in FIG. 2. For example, based on the GPS data, the computer 155 can determine which vehicle data corresponds to a respective vehicle 105 at a time of passing a position marker. The computer 155 can further determine, based on the GPS data, a lane position for the vehicle 105 at the position marker. Further, based on the heading data, the computer 155 can determine a heading for the vehicle 105, relative, e.g., to a centerline of a lane in which the vehicle 105 is travelling at a time of passing the position marker. In this manner, the computer 155 can be programmed to map the trajectories of each of the vehicles 105 during a data collection period to the region of interest. Upon mapping the vehicle 105 trajectories to the region of interest, the process 500 continues in a block 510.

In the block 510, the computer 155 clusters vehicle trajectories. As described below, the computer 155 may cluster the vehicle trajectories based on different operating parameters such lane position at a position marker, heading at a position marker, heading between two position markers, etc. For example, the computer 155 may be programmed to cluster the data into two sets. In an example, the computer 155 can apply a k-means clustering algorithm as described above with k equal to 2. K-means is only one example of data clustering. The computer 155 may apply other clustering algorithms to perform data clustering.

Additionally, the computer 155 may be programmed to apply different criteria for selecting and/or preparing the trajectory data to be clustered at different locations within the region of interest.

In one example, the computer 155 may be programmed to cluster the vehicle lane positions of each vehicle 105 at each position marker and/or the heading of each vehicle 105 at the position marker.

In another example, the computer 155 may be programmed to determine a heading of each vehicle between two position markers. For example, the computer 155 can calculate a heading of a straight line of travel between the two position markers. In this case, the computer 155 may cluster headings of the vehicles 105 between the two position markers.

In yet another example, the computer 155 may programmed to cluster the vehicle data based on two factors, for example, based on a lane position at a position marker, and a heading at the position marker. Upon clustering the trajectories of the vehicles 105 in the region of interest, the process 500 continues in a block 512.

In the block 512, the computer 155 identifies the centroid for the majority cluster for each set of clustered data. A centroid is the mean position of all the datum in the set of clustered data in all coordinate directions. A set of clustered data is defined herein as a set of data to which the computer 155 applied a clustering algorithm. For example, a set of clustered data may be the lane location data for the vehicles 105 at a position marker collected during a data collection period. The majority cluster is the cluster which includes the most datum (representing the most vehicles 105) after completion of the clustering algorithm. The computer 155 may further be programmed to identify the one or more centroids for other clusters for each set of clustered data. The process 500 continues in a block 514.

In the block 514, the computer 155 determines whether a difference between a centroid for a majority cluster is different from a baseline by more than a threshold. A baseline is a reference point, based on an expected value of an operating parameter or set of vehicle operating parameters. In some cases, the baseline may be based on historical data. For example, the computer 155 and/or the remote computer 170 may collect data from at least a minimum number of vehicles 105. The computer 155 can then determine, based on the data, expected behavior of vehicles 105 at different position markers within the region of interest. The expected behavior may be determined as an average of the data collected from the at least minimum number of vehicles 105, a mean of the data collected from the at least minimum number of vehicles 105, or some other relevant statistical value determined from the data. The minimum number of vehicles 105 may be selected to be a minimum number of vehicles 105 to provide a reasonable statistical reference point for evaluating deviations in vehicle operating parameters, e.g., 10,000 vehicles.

As another example, the baseline may be based on traffic regulations and/or expected driving behavior based on societal norms. For example, the baseline data may specify that the majority of vehicles 105 continue in their current lane of travel the majority of the time. As another example, the baseline data for acceleration on an open highway may be zero acceleration, based on the expectation that vehicles 105 maintain their speed of travel the majority of the time.

As another example, the baseline may be based on a state of a traffic signal at a time of collecting the vehicle operating parameters. For example, a baseline for acceleration for a vehicle 105 approaching a red light may be negative (deceleration) at a location. The velocity of a vehicle 105 approaching the red light may be reduced. In determining the baseline for a vehicle operating parameter, the computer 155 can be programmed, for example, to consider historical vehicle operating parameter data of vehicles 105 when experiencing same traffic signal conditions.

As another example, a baseline for vehicle lane position at a position marker may be the centerline of the lane. Based on vehicle data from a data collection period, a centroid of a majority cluster of vehicle lane positions at the position marker may be 0.8 meters. The threshold may be a predetermined distance selected to allow some tolerance for variation in driving behavior. For example, the threshold may be selected to be 0.5 meters. In this case, the computer 155 would determine that the distance, 0.8 meters, of the centroid for the majority cluster from the baseline (centerline of the lane) is greater than the predetermined threshold of 0.5 meters.

As another example, the clustered data may be a heading relative to the centerline of the lane between two position markers. The heading for the centroid of the majority cluster may be an angle of 35° relative to the centerline. The baseline may be historical data for a minimum number of vehicles (e.g., at least 10,000 vehicles), the expected heading between the two positions markers is straight, i.e., a heading parallel to the centerline. The threshold may be an angle of 5° relative to the centerline. Again, in this example, the computer 155 would determine that the difference between the centroid for the majority cluster (heading of 35° relative to the centerline) and the baseline (heading 0° relative to the centerline) is greater than the threshold, 5°.

In the case that the computer 155 calculates that a difference between a centroid and a respective baseline is greater than a respective threshold, the process 500 continues in a block 516. In the case that the computer 155 does not identify any centroids that deviate from a respective baseline by more than a respective threshold, the process 500 continues in a block 518.

In the block 516, the computer 155 reports a deviation in vehicle trajectories at the position marker, i.e., that a difference between the centroid of the majority cluster deviates from the baseline for the position marker by more than the threshold. The deviation may be reported, for example, to the remote computer 170. Additionally or alternatively, the computer 155 may report the deviation to vehicles 105 proximate to the infrastructure node 140. The process 500 continues in the block 518.

In the block 518, the computer 155 filters data providing operating parameters specifying vehicle velocities and accelerations. Vehicle velocity and acceleration data can specify a velocity and an acceleration of each vehicle 105 at each position marker in the region of interest, for example, the position markers 230, 232, 234 of FIG. 2. The computer 155 can be programmed to apply a filter, such as a low-pass filter or a Kalman filter, to the GPS data to smooth the acceleration and velocity curves of each of the vehicles 105 travelling through the region of interest during the data collection period. Upon filtering the velocity and acceleration data, the process 500 continues in a block 520.

In the block 520, the computer 155 clusters velocity and acceleration data for each vehicle 105 at each position marker. As an example, the computer 155 may apply a k-means algorithm with k=2. The computer 155 may identify centroids respectively for the majority velocity cluster at each position marker and for the majority acceleration cluster at each position marker. The process 500 continues in a block 522.

In the block 522, the computer 155 determines whether an absolute value of a difference between the acceleration centroid and a respective baseline is greater than a threshold. A baseline for acceleration may be, for example, an acceleration of zero kilometers per hour per second. The threshold may be selected to allow for some natural variation in acceleration as vehicles 105 adjust to driving conditions. For example, a threshold value may be selected to be 0.5 kilometers per hour per second.

In an example, a centroid of a majority acceleration cluster at a position marker may be minus five (−5) kilometers per hour per second. This would be an indication that the majority of vehicles 105 are slowing down at this position marker. This may be, for example, the result of a driving hazard such as debris on the road near the position marker. In this case the absolute value of the difference between the centroid of the majority acceleration cluster and the baseline would be five kilometers per hour per second. As above, the threshold may be 0.5 kilometers per hour per second. The computer 155 would determine that the difference between the centroid of the majority acceleration cluster and the baseline exceeds the threshold. The process 500 continues in a block 524.

In a case that the absolute value of the difference between the centroid for the majority cluster and the baseline is less than the threshold (the majority of vehicles are maintaining their speed), the process 500 continues in a block 526.

In the block 524, the computer 155 reports an acceleration deviation at the position marker when the difference between the centroid for the majority acceleration cluster is greater than the baseline by the threshold value. The computer 155 may report the deviation to the remote computer 170 and/or one or more vehicles 105 proximate to the infrastructure node 140. The process continues in a block 526.

In the block 526, the computer 155 determines whether the absolute value of a difference between a centroid of a majority velocity cluster and a baseline is greater than a threshold at a position marker. For example, a baseline for velocity may be the average velocity at a position marker, determined based on historical data for at least a minimum number of vehicles, e.g., 10,000 vehicles. As an example, the average rate of speed at a position marker may be 100 kilometers per hour. The threshold may be 15 kilometers per hour. This threshold may be selected to allow for expected variations in driving behavior.

In a case that the absolute value of the difference between the centroid for the majority velocity cluster and the baseline is greater than the threshold at the position marker, a majority of vehicles 105 are travelling faster or slower than expected at the position marker. The process 500 continues in a block 528. In a case that the difference is below the threshold (the majority of vehicles are driving within an expected range of driving speeds), the process 500 continues in a block 530.

In the block 528, the computer 155 reports the velocity deviation at the position marker. The computer 155 may report the velocity deviation to the remote computer 170 and/or to vehicles 105 proximate to the infrastructure node 140.

In the block 530, the computer 155 is programmed to cluster suspension operating parameters. Suspension operating parameters are vehicle operating parameters related to operation of the vehicle suspension, and may include, for example, a frequency of vibration of a suspension, an amplitude of vibration of the suspension, an amplitude of a pulse experienced by the suspension, etc. The computer 155 may be programmed to cluster one or more of these parameters for each vehicle 105 at each position marker during the data collection period. Alternatively, based on GPS data from the vehicles 105, and the suspension parameters, the computer 155 may identify one or more locations in the region of interest where large changes in suspension parameters of one or more vehicles 105 occur, and cluster suspension parameters at these one or more locations. The process 500 continues in a block 532.

In the block 532, the computer 155 determines whether a value of the difference between a centroid for a majority suspension cluster and a baseline is greater than a threshold. For example, in a case of an amplitude of vibration, a baseline amplitude of vibration for a suspension, based on historical data from at least a minimum number of vehicles 105 for a plurality of vehicles 105, may be two centimeters. A threshold to allow for variations in vehicles 105 may be selected to be 0.5 centimeters. In a case that the centroid for the majority suspension (amplitude) cluster is greater than the baseline plus the threshold (2.5 centimeters), the process continues in a block 534. In a case that the centroid for the majority suspension (amplitude) cluster is less than the baseline plus the threshold, the process 500 continues in a block 536. Note that in the case of suspension amplitude of vibration, a centroid of the majority cluster that is significantly below the baseline would not be considered a deviation as it most likely does not indicate a driving hazard. Accordingly, only suspension amplitude values greater than the baseline need to be considered by the computer 155.

The computer 155 may make the same type of cluster analysis with one or more other suspension parameters, such a frequency of vibration, or peak impulse amplitude. For each of the suspension parameters, the computer 155 may be programmed to determine whether a difference between a centroid of a majority of the datum and a baseline exceeds a threshold. The process 500 continues in the block 534 when the difference values exceed the thresholds and in the block 536 when the difference values do not exceed the threshold.

In the block 534, the computer 155 reports a suspension deviation. The computer 155 may be programmed to report the suspension deviation to the remote computer 170 and/or one or more vehicles 105 proximate to the infrastructure node 140.

In the block 536, the computer 155 clusters fog light data. Fog light data includes a binary value specifying that a fog light for a vehicle 105 is turned on or that it is turned off at a position marker. The computer 155 is programmed to determine what percentage of vehicles 105 have their fog lights turned on at the position marker.

The baseline for fog lights may be an expected percentage of vehicles that have their fog lights turned on based on historical data collected from at least a minimum number of vehicles. For example, a baseline may be that 10% of vehicles have their fog lights turned on. A threshold for deviation determinations may be 2%, to allow for normal variations in groups of vehicles 105.

In a case that the computer 155 determines that the percentage of vehicles with fog lights turned on at a position marker exceeds the baseline plus the threshold (12% in this example), the computer 155 identifies a fog light deviation. The process 500 continues in a block 540. Otherwise, the process 500 continues in a block 542.

In the block 542, the computer 155 clusters wiper data. For example, the computer 155 may cluster the wiper data according to wiping frequency for each of the vehicles 105 traveling through the region of interest at each of the position markers during the data collection period. Wiping frequency, as used herein, may be the number of cycles that a wiper executes in a second. A cycle may be defined as the wiper starting at one end of its motion, travelling to the other end of its motion, and then returning to the starting point. For example, the computer 155 can be programmed to cluster the data into two sets of data and determine the centroid for the majority wiper cluster. The process 500 continues in a block 544.

In the block 544, the computer 155 determines whether a difference between the centroid for the majority wiper cluster and a baseline (vehicle wiper speed in cycles per second) is greater than a threshold. In an example, the baseline vehicle wiper speed may be historical data of vehicle wiper speeds collected from at least a minimum number of vehicles 105 at each position marker. In one case, the historical data may be the mean wiper speed of all vehicles 105 that passed a position marker during a time period. In another case, the computer 155 may determine the baseline based in part on weather data. For example, the historical data of vehicle wiper speeds may be determined only for times when it is known to have been raining at the position marker.

In an example, the computer 155 may determine the centroid of the wiper frequency for vehicles 105 at a position marker to be one cycle per second. The baseline wiper speed for the position marker may also be one cycle per second. The threshold, selected to allow for some variation in vehicle 105 (and driver) behavior, may be 0.5 cycles per second. In this case, the difference between the centroid of the majority wiper cluster and the baseline is zero, and therefore less than the threshold. The computer 155 determines that there is no deviation in wiper operation. The process 500 continues in a block 550. In a case that the centroid of the majority wiper cluster was greater than the baseline plus the threshold (1.5 cycles per second), the computer 155 would determine that there is a deviation and continue in a block 546. This condition may indicate, for example, that the rain is particularly heavy at this position marker.

In the block 546, the computer 155 reports a deviation in wiper operation at the position marker where the centroid of the majority wiper cluster exceeded the baseline by more than the threshold. The computer 155 may report to the remote computer 170 and/or to one or more vehicles 105 proximate to the infrastructure node 140.

In the block 548, which follows the block 544, the computer 155 clusters electronic stability control data. In an example, electronic stability control data may indicate whether electronic stability control is active or not active. The computer 155 may determine, for each position marker, for what percentage of vehicles 105 passing the position marker during a data collection the electronic stability control is active. The process continues in a block 550.

In the block 550, the computer 155 determines whether the percentage of vehicles 105 with activated electronic stability control at a position marker is greater than a baseline number of vehicles with activated electronic stability control plus a threshold. The baseline may be determined based on historical data collected from at least a minimum number of vehicles, indicating, for example, an average percentage of vehicles 105 for which electronic stability control is active at the position marker. In the case that the percentage of vehicles with activated electronic stability control at the position marker exceeds the baseline plus a threshold, the process 500 continues in a block 552. Otherwise, the process 500 ends.

In the block 552, the computer 155 is programmed to report the electronic stability control deviation to the remote computer 170 and/or one or more vehicles 105 proximate to the infrastructure node 140.

The processes 400 and 500 above are described as performed by a computer 155 in an infrastructure node 140. However, a portion or all of the processes 400 and 500 may be performed totally, or in part, by other computers such as a vehicle computer 110 or the remote computer 170.

The processes 400 and 500 describe non-limiting examples of identifying changed driving conditions based on vehicle operating parameters including vehicle lane position, vehicle heading, vehicle speed, vehicle acceleration, suspension operation, fog light actuation, wiper speed, and stability control operation. Although described with respect to specific individual operating parameters and specific combinations of vehicle operating parameters, identification of a changed driving condition can be performed based on analysis of any individual vehicle operating parameter, and/or, any combination of vehicle operating parameters. Further, the computer 155 or other computer may be programmed to evaluate other vehicle operating parameters such as steering angle, braking, activation of anti-lock braking, etc. In each case, the computer 155 may be programmed to cluster vehicle operating data from a plurality of vehicles passing a position marker during a data collection time period, determining a centroid for a majority cluster of the vehicle, and determining if the difference between the centroid and a baseline for the operating parameter is greater than a threshold.

As used herein, the adverb "substantially" means that a shape, structure, measurement, quantity, time, etc. may deviate from an exact described geometry, distance, measurement, quantity, time, etc., because of imperfections in materials, machining, manufacturing, transmission of data, computational speed, etc.

As used herein, the term "based on" means based on in whole or in part.

In general, the computing systems and/or devices described may employ any of a number of computer operating systems, including, but by no means limited to, versions and/or varieties of the Ford Sync® application, AppLink/Smart Device Link middleware, the Microsoft Automotive® operating system, the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OSX and iOS operating systems distributed by Apple Inc. of Cupertino, Calif., the BlackBerry OS distributed by Blackberry, Ltd. of Waterloo, Canada, and the Android operating system developed by Google, Inc. and the Open Handset Alliance, or the QNX® CAR Platform for Infotainment offered by QNX Software Systems. Examples of computing devices include, without limitation, an on-board vehicle computer, a computer workstation, a server, a desktop, notebook, laptop, or handheld computer, or some other computing system and/or device.

Computers and computing devices generally include computer-executable instructions, where the instructions may be executable by one or more computing devices such as those listed above. Computer executable instructions may be compiled or interpreted from computer programs created using a variety of programming languages and/or technologies, including, without limitation, and either alone or in combination, Java™, C, C++, Matlab, Simulink, Stateflow, Visual Basic, Java Script, Perl, HTML, etc. Some of these applications may be compiled and executed on a virtual machine, such as the Java Virtual Machine, the Dalvik virtual machine, or the like. In general, a processor (e.g., a microprocessor) receives instructions, e.g., from a memory, a computer readable medium, etc., and executes these instructions, thereby performing one or more processes, including one or more of the processes described herein. Such instructions and other data may be stored and transmitted using a variety of computer readable media. A file in a computing device is generally a collection of data stored on a computer readable medium, such as a storage medium, a random-access memory, etc.

Memory may include a computer-readable medium (also referred to as a processor-readable medium) that includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random-access memory (DRAM), which typically constitutes a main memory. Such instructions may be transmitted by one or more transmission media, including coaxial cables, copper wire and fiber optics, including the wires that comprise a system bus coupled to a processor of an ECU. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

With regard to the media, processes, systems, methods, heuristics, etc. described herein, it should be understood that, although the steps of such processes, etc. have been described as occurring according to a certain ordered sequence, such processes may be practiced with the described steps performed in an order other than the order described herein. It further should be understood that certain steps may be performed simultaneously, that other steps may be added, or that certain steps described herein may be omitted. In other words, the descriptions of processes herein are provided for the purpose of illustrating certain embodiments, and should in no way be construed so as to limit the claims.

Accordingly, it is to be understood that the above description is intended to be illustrative and not restrictive. Many embodiments and applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their plain and ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A system comprising an infrastructure node including a computer mounted to a structure of the infrastructure node, the computer including a processor and a memory storing instructions such that the processor is programmed to:

prior to clustering vehicle operating parameter values from each of a plurality of vehicles at a location within a time, identify a number of clusters, defined for a position marker that indicates a position along a lane of a roadway, into which to cluster the vehicle operating parameter values;

cluster the vehicle operating parameter values into the identified number of clusters, wherein the clustering the vehicle operating parameter values includes clustering data from the plurality of vehicles based on proximity to two or more respective means;

determine a reportable condition when a mean for a cluster representing a greatest number of vehicles varies from a baseline by more than a threshold; and report the reportable condition to at least one of a remote computer or one of the plurality of vehicles.

2. The system of claim 1, wherein the baseline is an expected value of the vehicle operating parameter values.

3. The system of claim 1, wherein the baseline is determined based on historical data gathered at the location from at least a minimum number of vehicles.

4. The system of claim 1, wherein the baseline is determined based on one or more traffic regulations.

5. The system of claim 1, wherein the baseline is determined based on weather data.

6. The system of claim 1, wherein the vehicle operating parameter values from each of the plurality of vehicles is a respective value of a same vehicle operating parameter.

7. The system of claim 6, wherein the same vehicle operating parameter is one of: a vehicle speed, a vehicle position relative to the lane, a vehicle acceleration, a vehicle trajectory, a vehicle wiper speed, an actuation of fog lights, an operating parameter specifying operation of a vehicle suspension and an actuation of electronic stability control.

8. The system of claim 6, wherein the vehicle operating parameter values for each of the plurality of vehicles includes a value of a same first vehicle operating parameter from each vehicle and a value of a same second vehicle operating parameter from each vehicle.

9. The system of claim 1, wherein the processor is further programmed to determine the mean for the vehicle operating parameter values respectively for each of the two or more clusters based on a k-means algorithm.

10. The system of claim 1, wherein the processor is further programmed to report the location to at least one of: a server, a vehicle included in the plurality of vehicles, and a vehicle not included in the plurality of vehicles.

11. The system of claim 1, wherein the computer is included in a traffic infrastructure.

12. The system of claim 1, wherein the processor is programmed to:

apply a filter to at least some of the data prior to determining the two or more clusters of vehicle operating parameter values from each of the plurality of vehicles at the location within the time.

13. The system of claim 12, wherein the filter is one of a low-pass filter or a Kalman filter.

14. A method comprising:

prior to clustering vehicle operating parameter values from each of a plurality of vehicles at a location within a time, identifying, with a computer of an infrastructure node, a number of clusters, defined for a position marker that indicates a position along a lane of a roadway, into which to cluster the vehicle operating parameter values;

clustering the vehicle operating parameter values into the identified number of clusters, wherein the clustering the vehicle operating parameter values includes clustering data from the plurality of vehicles based on proximity to two or more respective means;

determining a reportable condition when a mean for a cluster representing a greatest number of vehicles varies from a baseline by more than a threshold; and reporting the reportable condition to at least one of a remote computer or one of the plurality of vehicles.

15. The method of claim 14, wherein the baseline is determined based on historical data gathered at the location from at least a minimum number of vehicles.

16. The method of claim 14, wherein the vehicle operating parameters from each of the plurality of vehicles is a same operating parameter.

17. The method of claim 14, further comprising:

determining the mean for the vehicle operating parameter values respectively for each of the two or more clusters based on a k-means algorithm.

18. The method of claim 14, further comprising:

applying a filter to at least some of the data prior to determining the two or more clusters of vehicle operating parameter values from each of the plurality of vehicles at the location within the time.

* * * * *